US005214822A

United States Patent [19]

Sakurai et al.

[11] Patent Number: 5,214,822

[45] Date of Patent: Jun. 1, 1993

[54] VACUUM CLEANER

[75] Inventors: Hidetoshi Sakurai; Gorou Sasai; Kouiti Sagawa, all of Hitachi, Japan

[73] Assignee: Hitachi, Ltd., Tokyo, Japan

[21] Appl. No.: 814,762

[22] Filed: Dec. 30, 1991

Related U.S. Application Data

[62] Division of Ser. No. 585,927, Sep. 21, 1990, Pat. No. 5,134,749.

[51] Int. Cl.[5] ..... A47L 9/00

[52] U.S. Cl. ..... 15/326; 15/327.2

[58] Field of Search ..... 15/327.1, 327.2, 327.4, 15/325

[56] References Cited

U.S. PATENT DOCUMENTS 2,686,330 8/1954 Wales ..... 15/327.4
2,779,432 1/1957 Meyerhoefer ..... 15/323 X
4,697,299 10/1987 Brinkhoff et al. ..... 15/327.2 X

FOREIGN PATENT DOCUMENTS 1310618 10/1962 France ..... 15/327.4

*Primary Examiner*—Chris K. Moore
*Attorney, Agent, or Firm*—Antonelli, Terry, Stout & Kraus

[57] ABSTRACT

A vacuum cleaner includes a cleaner body to which an intake hose is connectable, traveling members for enabling the traveling of the cleaner body, and an obstacle-escaping angularly-movable member angularly movably mounted on the cleaner body. A dust collector chamber is formed in a front portion of the cleaner body, and an electrically-operated fan is mounted in a rear portion of the cleaner body. The angularly-movable member is so arranged as to be angularly movable around an outer wall of the dust collector chamber. A portion of the angularly-movable member projects outwardly from the front face of the cleaner body and the front side portions of the cleaner body.

8 Claims, 16 Drawing Sheets

VACUUM CLEANER

This is a divisional of application Ser. No. 07/585,927, filed Sep. 21, 1990 now U.S. Pat. No. 5,134,749, issued Aug. 4, 1992.

BACKGROUND OF THE INVENTION

1. Field of the Invention

This invention relates to a vacuum cleaner suitable for cleaning a surface of a floor, a carpet, a mat or the like while moving a cleaner body on the surface to be cleaned.

2. Related Art

There have been conventionally proposed vacuum cleaners designed to prevent a cleaner body or a handgrip from being caught by the furniture or legs of a desk when moving the vacuum cleaner, so as to improve the usability of the vacuum cleaner. Japanese Utility Model Unexamined Publication No. 63-103852 discloses one such cleaner in which plurality of rollers are mounted respectively on corner portions of the cleaner body, and also discloses another such cleaner in which a rotary roller handgrip greater in width than the cleaner body is provided at a front upper portion of the cleaner body.

In the former of the above prior art, the rollers are mounted respectively on the corner portions at the outer periphery of the cleaner body so as to prevent the cleaner body from being caught by the furniture or legs of a desk. However, this cleaner has a disadvantage that when an angular portion of the desk leg, a pillar or the like is engaged in between the rollers, such an obstacle can not be avoided. The latter conventional cleaner is free from the above disadvantage; however, since the rotary roller also serves as the handgrip, the cleaner body is unstable and unsatisfactory in usability when using the handgrip, and its strength is rather low.

SUMMARY OF THE INVENTION

With the above deficiencies of the prior art in view, it is an object of this invention to provide a vacuum cleaner which can easily escape an obstacle on a surface to be cleaned even if the outer contour of the cleaner body is generally flat, and has excellent traveling and handling abilities.

The above object has been achieved by a vacuum cleaner comprising a cleaner body to which an intake hose is connectable; traveling for enabling the traveling of the cleaner body; and an obstacle-escaping angularly-movable member angularly movably mounted on the cleaner body; a dust collector chamber being formed in a front portion of the cleaner body; an electrically-operated fan being provided in a rear portion of the cleaner body; the angularly-movable member being so arranged as to be angularly movable around an outer wall of the dust collector chamber; and part of the angularly-movable member being projected from a front face of the cleaner body and front side surfaces of the cleaner body.

When a cleaning operation is carried out, pulling the intake hose, the cleaner body is caused to travel on a surface to be cleaned, by means of the traveling members.

If there is an obstacle, such as a desk, on the surface to be cleaned, the cleaner body collides with this obstacle. In this case, since the angularly-movable member is projected outwardly from upper and lower cases of the cleaner body, the angularly-movable member is first brought into abutment against the obstacle. In this condition, when the intake hose is further pulled, the angularly-movable member is angularly moved. and the cleaner body turns in a direction away from the obstacle, without falling, so that finally the cleaner body is smoothly moved to a position to escape the obstacle.

Since the angularly-movable member is so arranged as to be angularly movable around the outer wall of the dust collector chamber, the provision of the angularly-movable member will not increase the height of the cleaner body.

The foregoing objects, features and advantages of the invention will be made clearer from the description of preferred embodiments of the invention hereinafter referring to drawings.

BRIEF DESCRIPTION OF THE DRAWINGS

FIGS. 1 to 14 show a preferred embodiment of a vacuum cleaner of the invention;

FIG. 1 is a vertical cross-sectional view of an important portion of the vacuum cleaner;

FIG. 2 is an exploded perspective view of the vacuum cleaner;

FIG. 3 is a bottom view of the vacuum cleaner;

FIG. 6 is a perspective view of the vacuum cleaner as seen from an upper side of the cleaner;

FIG. 7 is a perspective view of the vacuum cleaner as seen from an reverse side of the cleaner;

FIG. 8 is a vertical cross-sectional view of a clamp portion, showing a lid member in its closed condition;

FIG. 9 is a vertical cross-sectional view of the clamp portion, showing the lid member in its open condition;

FIG. 10 is a perspective view, showing a portion of the vacuum cleaner where the lid member is connected to an upper case;

FIG. 11 is a bottom view of a lower case cover;

FIG. 12 is a fragmentary vertical cross-sectional view, showing an elastic support for a pressure sensor;

FIG. 13 is a fragmentary perspective view, showing the pressure sensor;

FIG. 14 is a fragmentary perspective view showing the elastic support; and

FIGS. 15 to 26 show other embodiments of the invention in which;

FIG. 15 is a partly-broken, plan view of a first one of the other embodiments;

FIG. 16 is a side-elevational view of the embodiment of FIG. 15;

FIG. 17 is an exploded perspective view of an important portion of a second one of the other embodiments;

FIG. 18 is an exploded perspective view of an important portion of a third one of the other embodiments;

FIG. 19 is a perspective view of the important portion of FIG. 18 in an assembled condition;

FIG. 20 is a partly-broken, side-elevational view of a fourth one of the other embodiments;

FIG. 21 is a top plan view of the embodiment of FIG. 20;

FIG. 22 is a bottom view of the embodiment of FIG. 20;

FIGS. 23 and 24 are schematic views illustrative of an obstacle-avoiding operation of the embodiment of FIG. 20;

FIG. 25 is a bottom view of a fifth one of the other embodiments; and

FIG. 26 is a bottom view of a sixth one of the other embodiments.

DESCRIPTION OF THE PREFERRED EMBODIMENTS OF THE INVENTION

Figure 1:
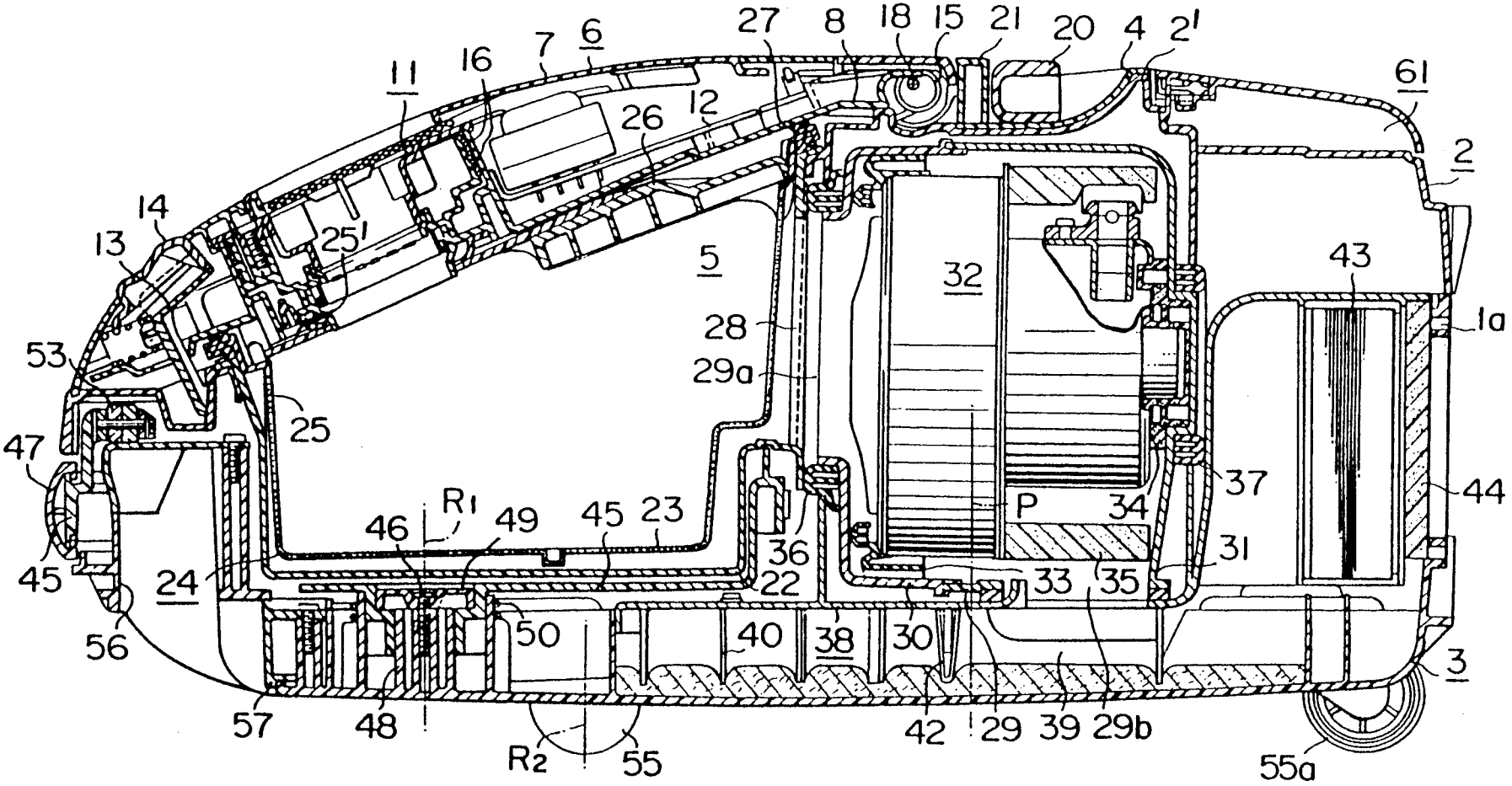
Figure 2:
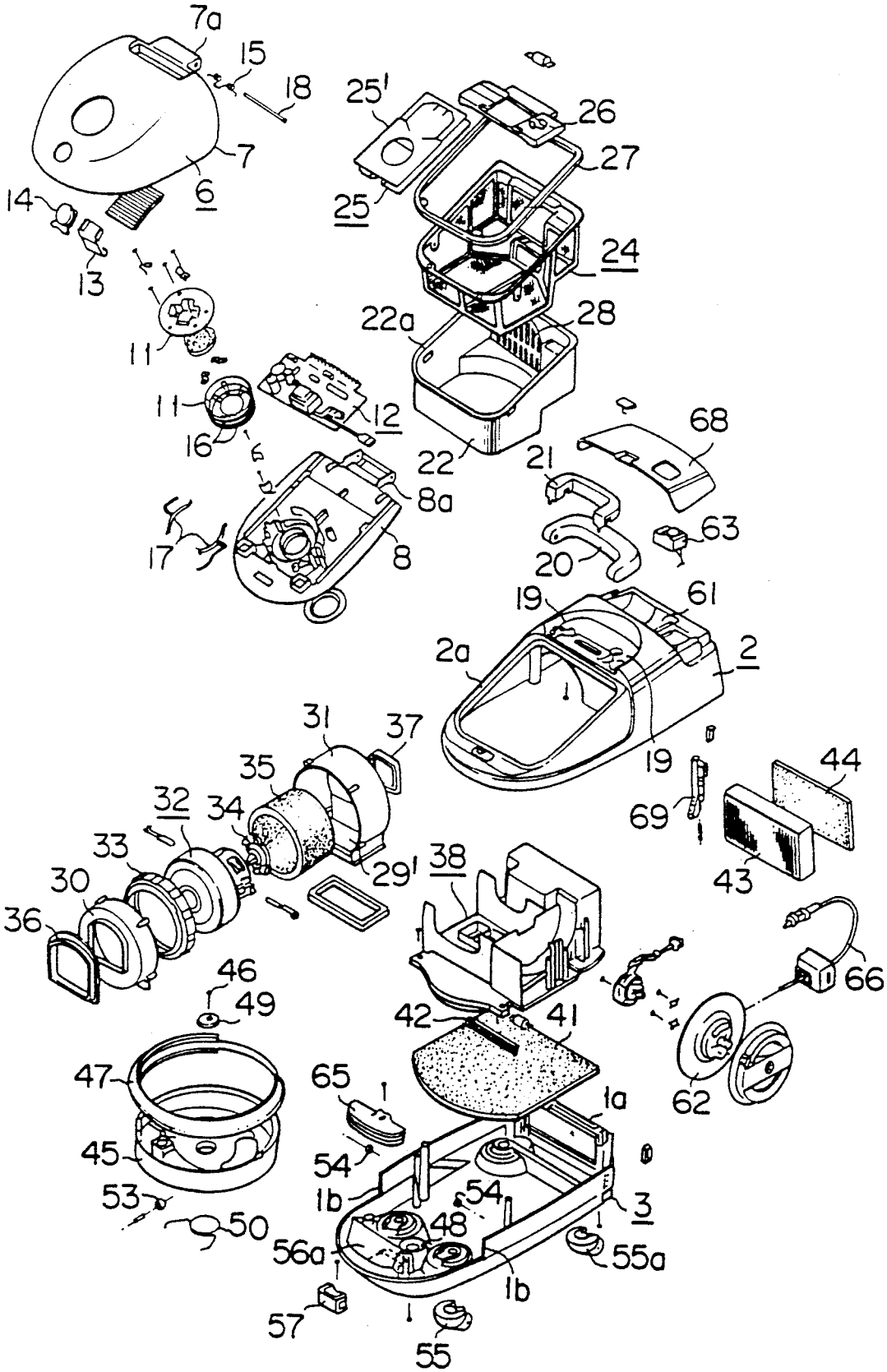
Figure 3:
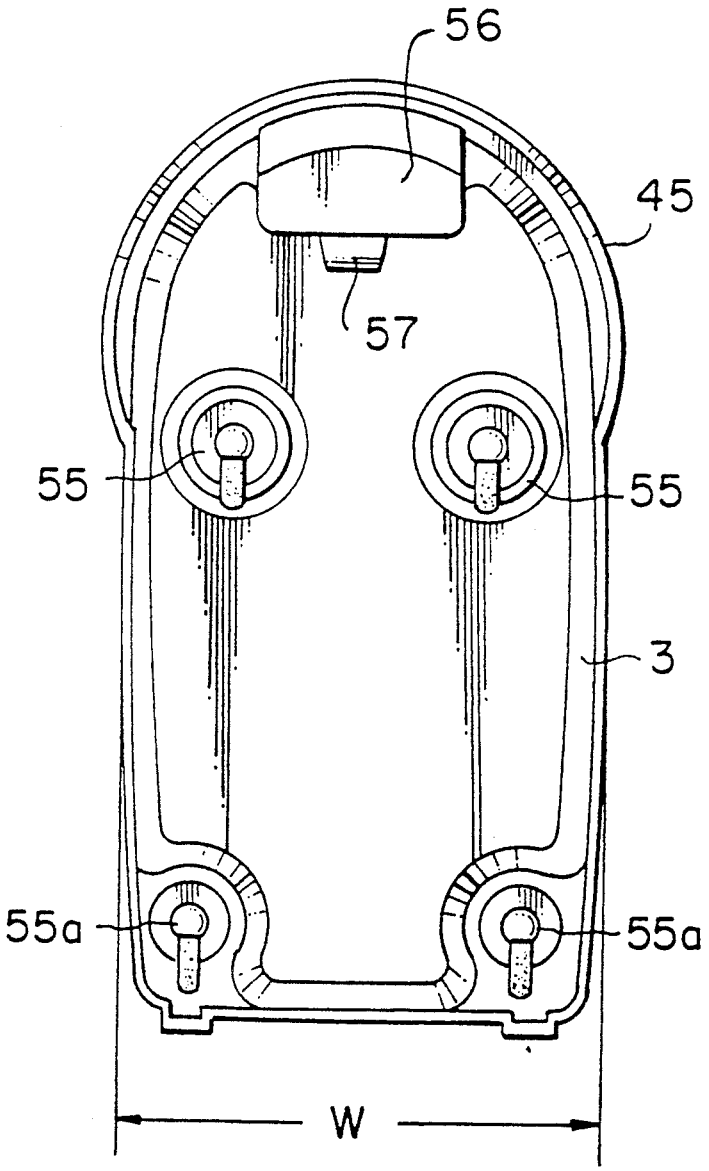

Preferred embodiments of the invention will now be described in detail with reference to the drawings.

Referring to the drawings, a cleaner body 1 of an electrically-operated vacuum cleaner comprises an upper case 2 of a rigid thermoplastic resin (Rockwell hardness: 50 to 80), and a lower case 3 of a rigid thermoplastic resin (Rockwell hardness: 50 to 80). A soft material 4 is integrally molded on the entire surfaces of the upper and lower cases 2 and 3.

The soft material 4 is made of an elastic thermoplastic resin, and has a thickness of about 1.5 mm to about 3.5 mm, and has a rubber Shore hardness of about 30 to about 40. A dust collector chamber 5 having an open top is provided at a front portion of the cleaner body 1. The opening or open top of the dust collector chamber 5 is closed by an openable lid member 6 which comprises an outer lid 7 and an inner lid 8. The outer lid 7 and the inner lid 8 are connected together by screws 9. The outer and inner lids 7 and 8 are made of a rigid thermoplastic resin. Mounted between the outer and inner lids 7 and 8 are an angularly-movable hose connecting portion 11 to which an intake hose 11 is connectable, a cleaning-operation control board 12, a clamp 13 for the opening and closing of the lid member 6, and a coil-like spring 15 urging the lid member 6 in its opening direction.

The hose connecting portion 11 has slip rings 16 at its outer periphery. A contact piece 17 in sliding contact with the slip ring 16 is provided in the inner lid 8, and a proximal operating portion 10' on the intake hose 10 is electrically connected to the control board 12 through the contact piece 17.

An angularly-movable shaft 18 in the form of a metal rod is fitted in a mounting piece **7*a* of the outer lid 7 and a mounting piece 8*a* of the inner lid 8. The angularly-movable shaft 18 is, together with a handle 20, mounted on a mounting portion 19 on the upper surface of the upper case 2 through a handle holder 21, so that the lid member 6 is mounted on the upper case 2 so as to be angularly moved. The coil-like spring 15 is fitted on the angularly-movable shaft 18, and applies an urging force so that upon disengagement of the clamp 13, the lid member 6** can be moved in its opening direction.

The inner wall of the dust collector chamber 5 is defined by an inner case 22 of a rigid thermoplastic resin. An edge **22*a* of the opening of the inner case 22 is fixed near to an edge 2*a* of the opening of the upper case 2. A dust collector container 24 is received in the inner case 22, the dust collector container 24 comprising a non-woven fabric 23 and a frame of a synthetic resin integrally molded to the non-woven fabric 23. The dust collector container 24 can arrest fine dust, and can maintain its shape. A paper bag filter 25 is received in the dust collector container 24. A holder 26 of a synthetic resin is angularly movably mounted on an inlet portion of the dust collector container 24. The holder 26 serves to hold a base plate 25' of the paper bag filter 25 at the inlet portion of the dust collector container 24. In the case where the paper bag filter 25 is provided directly in the inner case 22 without the use of the dust collector container 24, the holder 26 is angularly movably mounted adjacent to the edge 2*a* of the opening of the upper case 2**.

A seal packing 27 for pressure contact with the inner lid 8 is mounted on the edge of the opening of the dust collector container 24. The seal packing 27 has such a shape that it also is in pressure contact with the edge **22*a* of the opening of the inner case 22**.

The inner case 22 has a lattice-like communication window 28. A motor case 29 is provided at the rear portion of the cleaner body 1. The motor case 29 comprises a front case 30 and a rear case 31, and an electrically-operated fan 32 is mounted within the motor case 29, and is resiliently held and fixed between front and rear cushioning materials 33 and 34 each made of rubber. An air-permeable noise insulating tube 35 is mounted around a motor portion of the electrically-operated fan 32. The motor case 29 is incorporated on an upper side of a lower case cover 38 through front and rear elastic materials 36 and 37. An exhaust passage 39 is formed between the lower case cover 38 and the lower case 3. A plurality of generally U-shaped ribs 40 are formed on the lower surface of the lower case cover 38. A noise insulating material 41 for reducing the noises caused by an exhaust stream, a metal net 42 for rectifying the exhaust stream, a fine dust-arresting filter 43 of a generally box-shape, and an exhaust filter 44 are mounted.

The communication window 28 of the inner case 22 is in communication with a front opening **29*a* of the motor case 29. A lower opening 29*b* of the motor case 29 is in communication with the exhaust passage 39. When the electrically-operated fan 32 is rotated, the air fed through the intake hose 10 passes through the paper bag filter 25 and the dust collector container 24, and further flows through the communication window 28 into the electrically-operated fan 32 to form an exhaust stream. Then, this exhaust air flows through the lower opening 29*b* of the motor case 29, the metal net 29, the fine dust-arresting filter 43 (which is capable of arresting 99% of dust of 0.3 micron meter) and the exhaust filter 44 (which is mainly designed to rectify the exhaust stream and is made of an air-permeable sponge), and then is discharged to the exterior of the cleaner body 1 through an exhaust port 1*a* provided at the rear face of the cleaner body 1**.

An angularly-movable member 45 for enabling the cleaner body 1 to escape an obstacle is so mounted as to angularly move around the outer periphery of the inner case. The angularly-movable member 45 is made of a synthetic resin, and has a disk-shape. A bumper 47, made of a soft material such as a vinyl chloride resin, is mounted on the outer periphery of the angularly-movable member 45. The angularly-movable member 45 comprises a bottom plate **45*a* and an annular frame 45*b*, and the bumper 47 is mounted on the outer surface of the annular frame 45*b***.

Part of the outer periphery of the bumper 47 mounted on the angularly-movable member 45 is projected from the front face and the front side surfaces of the cleaner body 1. The maximum amount of the projecting from the lower case 3 is about 6 mm, and the maximum amount of the projection from the upper case 2 is about 4 mm.

The angularly-movable member 45 is supported on a bearing portion 48, integrally molded on the inner bottom surface of the lower case 3, by a fastening element (e.g. a screw) 46 and a retainer cover 49, so that the angularly-movable member 45 can be angularly moved in either of right and left directions, that is, in normal and reverse directions. The outer diameter of the annular frame 45*b* of the angularly-movable member 45 is substantially equal to the maximum transverse width W of the cleaner body 1. In this embodiment, the maximum transverse width W is set to 260 mm. The axis R1 of angular movement of the angularly-movable member 45 is displaced or offset toward the front side of the clear body 1 from a vertical line P passing through the center of gravity of the cleaner body 1. The angularly-movable member 45 is provided with an angular movement angle limiting means for limiting the angular movement angle to a range of about 60° to 180°.

An angular movement spring 50 is mounted around the bearing portion 48 formed on the lower case 3. One end of the angular movement spring 50 is engaged with a receptive portion 51 formed on the inner bottom surface of the lower case 3, and the other end of this spring is engaged with a receptive portion 52 formed integrally on the bottom plate 45*a* of the angularly-movable member 45. When the bumper 47 collides with an obstacle, such as a desk, on the surface to be cleaned, the angularly-movable member 45 is angularly moved, but when the bumper 47 is disengated from the obstacle, the angularly-movable member 45 is returned to its initial position by the reaction force of the angular movement spring 50.

Figure 5A:
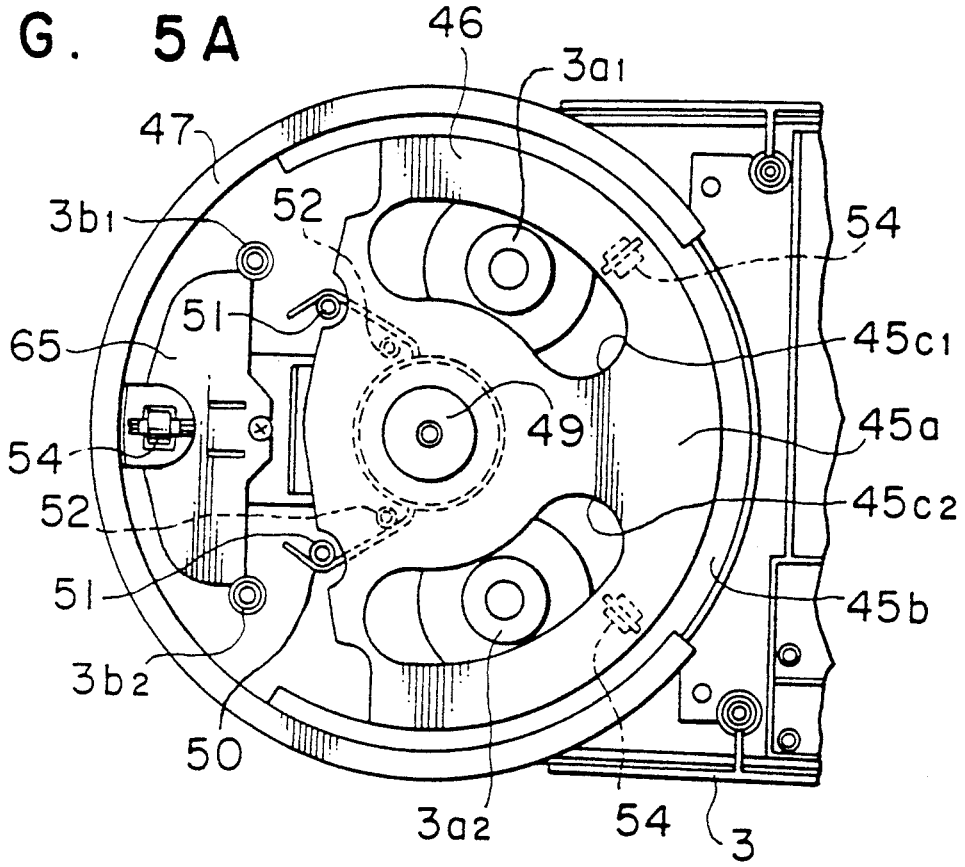
FIG. 5A and 5B are cross-sectional views of an important portion of the vacuum cleaner.
Figure 5B:
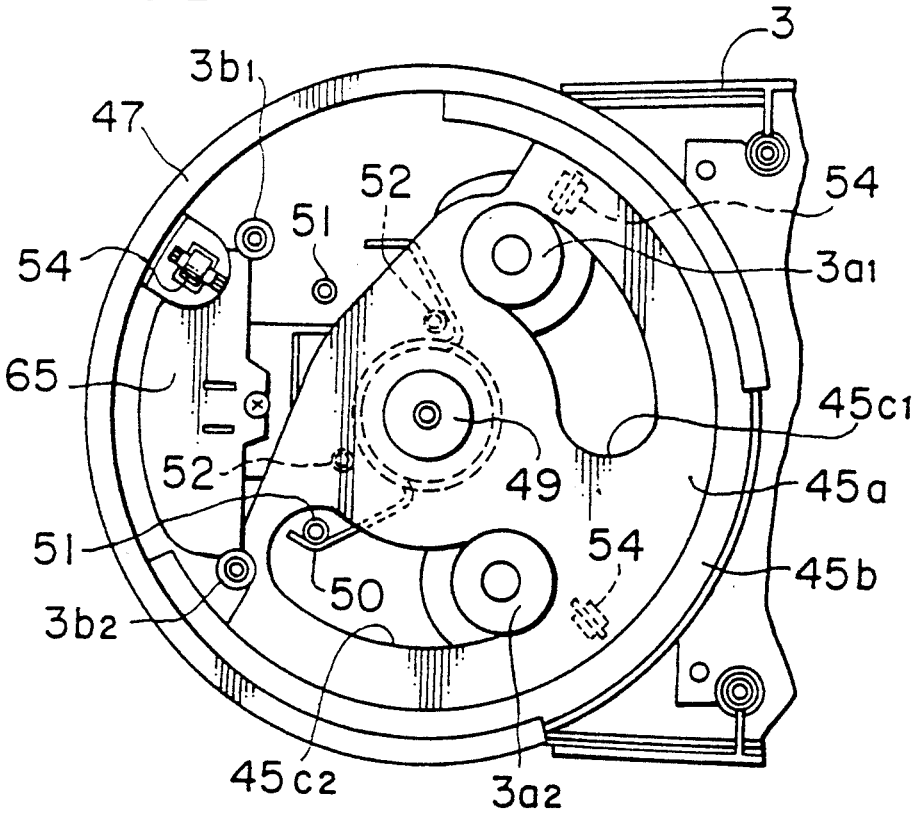

As shown in FIGS. 5A and 5B, two slots 45*c*1 and 45*c*2 are formed through the bottom plate 45*a* of the angularly-movable member 45. Two bosses 3*a*1 and 3*a*2 formed on the inner bottom surface of the lower case 3 are received in the two slots 45*c*1 and 45*c*2, respectively. Formed on the inner bottom surface of the lower case 3 are small projections 3*b*1 and 3*b*2 for abutting respectively against the ends of the bottom plate 45*a* of the angularly-movable member 45. When the angularly-movable member 45 is angularly moved through a predetermined angle, the bosses 3*a*1 and 3*a*2 are abutted against the ends of the slots 45*c*1 and 45*c*2, respectively, and also the small projections 3*b*1 and 3*b*2 are abutted against the bottom plate 45*a*. As a result, the angle of angular movement of the angularly-movable member 45 is limited. In this embodiment, the angularly-movable member 45 is set to be angularly movable through 60°, that is, 30° in the left direction and 30° in the right direction.

Ends 1*b* formed respectively at the front side portions of the cleaner body 1 for the entrance and exit for the angularly-movable member 45 are disposed rearwardly of the axis R1 of angular movement of the angularly-movable member 45. It is preferred that the bumper 47 mounted on the angularly-movable member 45 should be projected at least over the entire transverse width of the front face of the cleaner body 1. In this embodiment, although only the bumper 47 is projected from the soft material 4 mounted on the upper case 2 as shown in FIG. 1, both the bumper 47 and the angularly-movable member 45 may be projected therefrom.

When viewed from the top of the cleaner body 1, the intake hose 10 is disposed substantially on a centerline Q1 of the transverse width of the cleaner body 1. The intake hose 10 is connected to the lid member 6, and this connecting portion is disposed above the angularly-movable member 45. When viewed from the top of the cleaner body 1, the shape of that portion of the angularly-movable member 45 projecting from the cleaner body 1 should preferably be substantially symmetrical right and left with respect to the centerline Q1. An operating button 14 for the clamp 13 has a recess 14*a* indicating the optimum position of pressing of this button.

In order that the angularly-movable member 45 can be smoothly moved angularly around the inner case 22, a plurality of rollers 53 are mounted on the outer peripheral portion of the angularly-movable member 45. A plurality of rollers 54 are mounted on the inner bottom surface of the lower case 3 so as to receive the outer bottom surface of the angularly-movable member 45. By virtue of the provision of the rollers 53 and 54, the angularly-movable member 45 can be smoothly moved angularly between the upper case 2 and the lower case 3.

Figure 7:
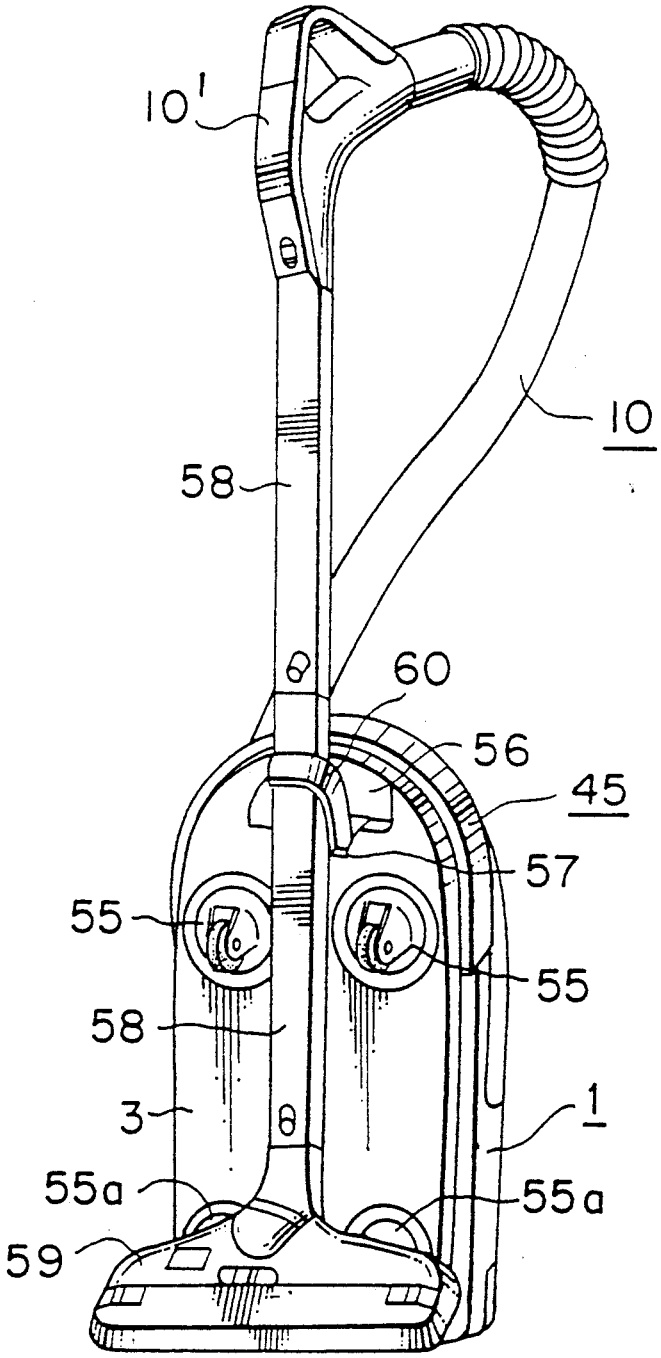
Figure 8:
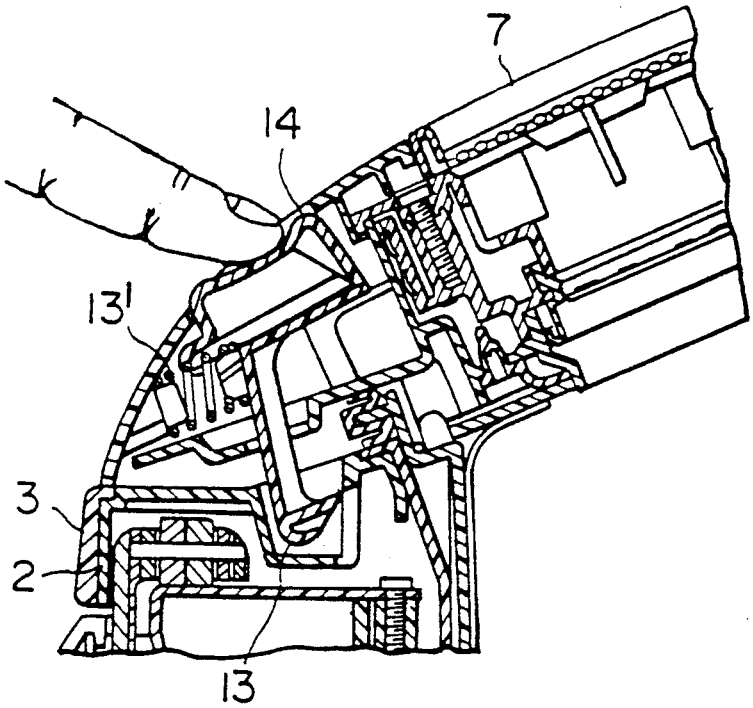
Figure 9:
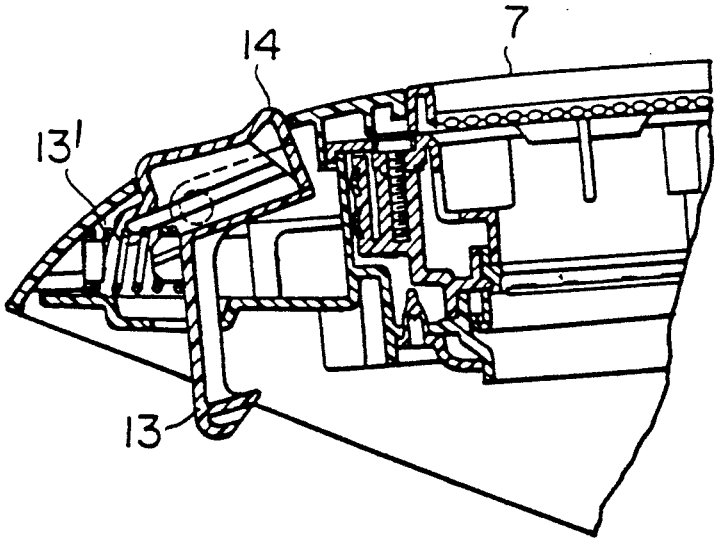
Figure 10:
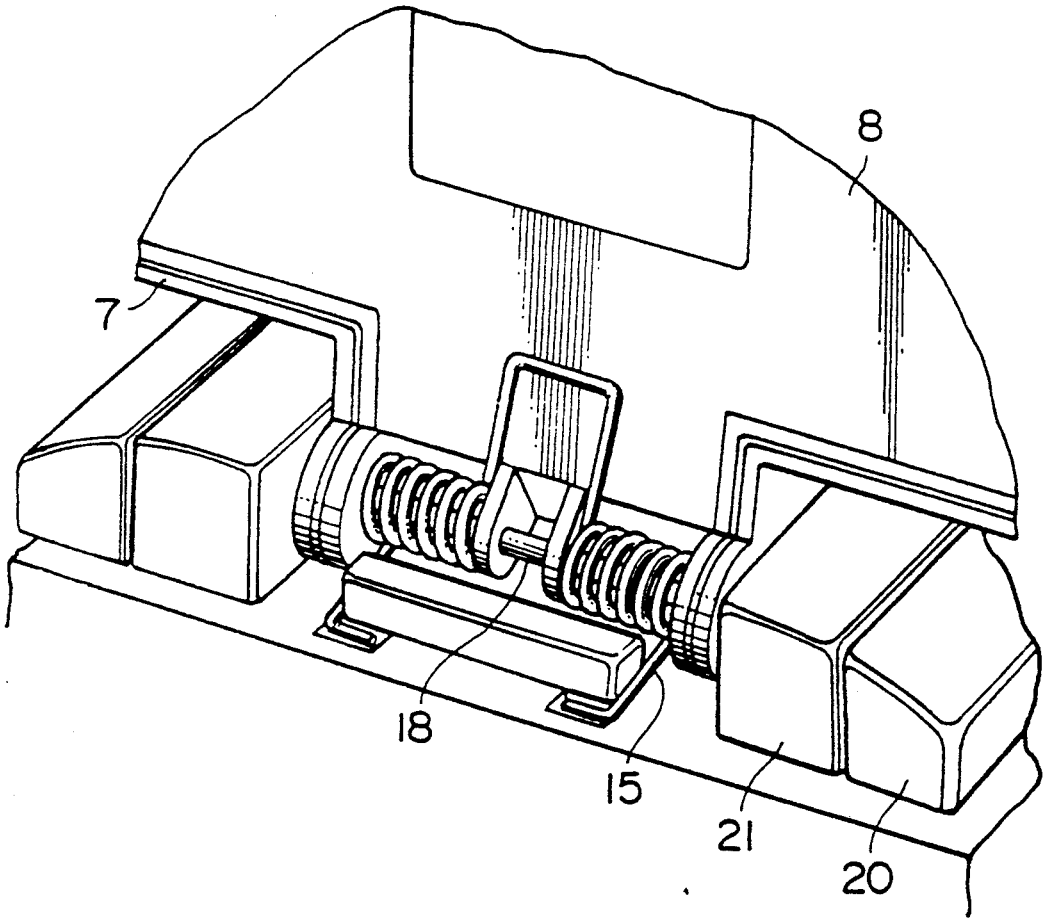
Figure 11:
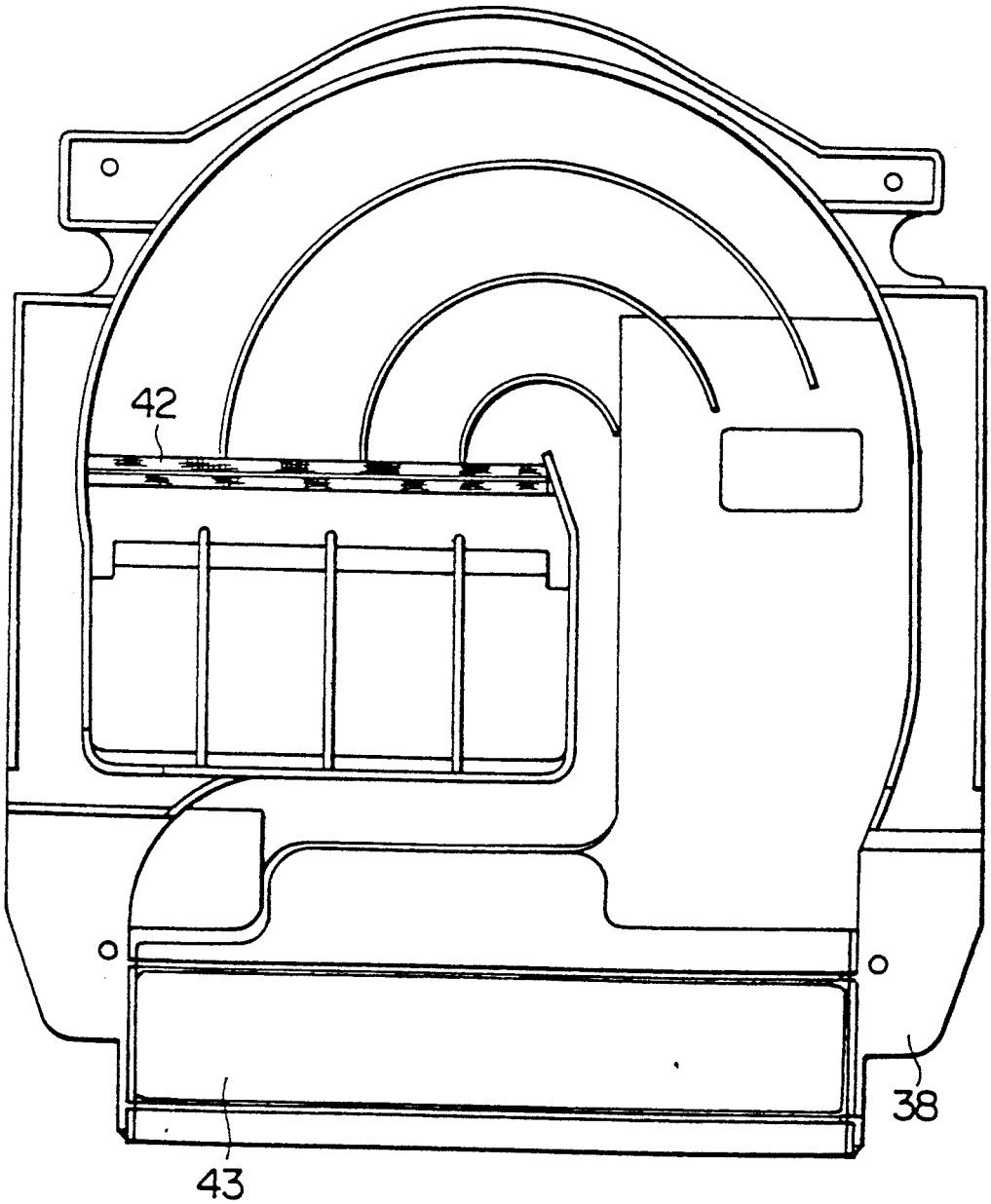
Figure 12:
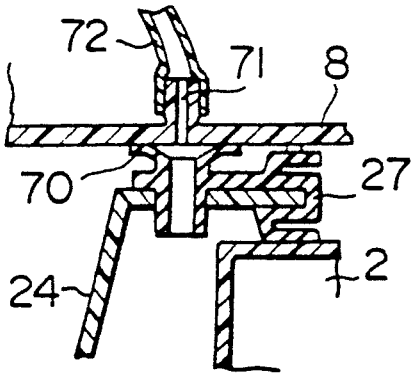
Figure 13:
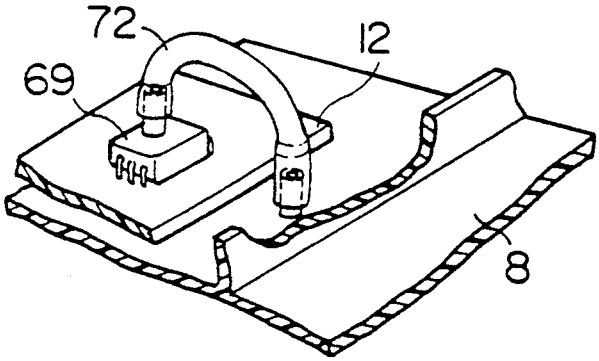
Figure 14:
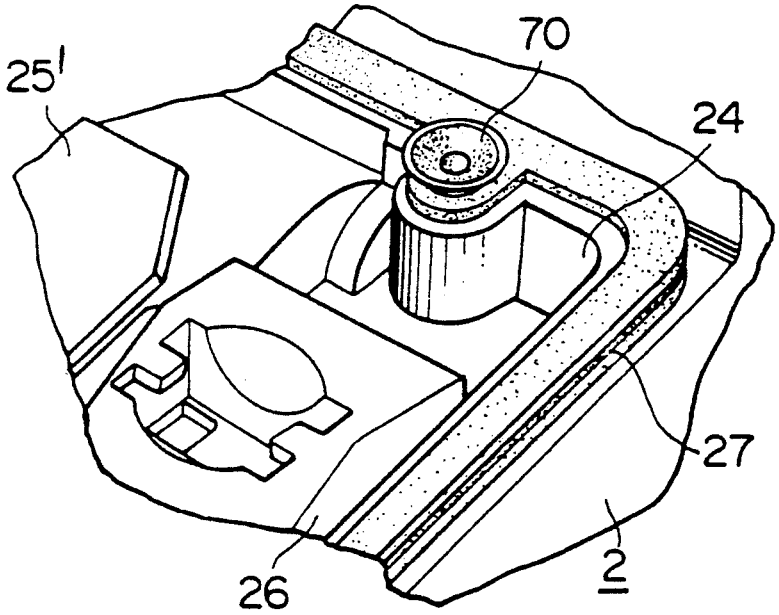

A pair of front casters 55 and a pair of rear casters 55*a* are mounted on the lower bottom surface of the lower case 3. A downwardly-opening recess 56*a* is formed at the front portion of the lower surface of the lower case 3, and a hose stand retainer 57 for the intake hose 10 is formed on a fixed handle portion 56. Extension pipes 58 are connected to the suction hose 10, and a suction member 59 is connected to the extension pipe 58, and in this condition, by engaging a fixed hook 60, formed on the extension pipe 58, with the hose stand retainer 57, the intake hose 10 and the associated parts can be put in a rest position in a generally upstanding manner as shown in FIG. 7.

A container chamber 61 for containing small attachments such as a corner brush is formed at the upper rear portion of the cleaner body 1. A cord reel 62 is mounted between the lower case cover 38 and the upper case 3. An operating button 63 for the cord reel 62 is provided in the vicinity of the container chamber 61, and can be manipulated at the upper rear portion of the cleaner body 1.

That portion of the intake hose 10 connected to the lid member 6 is disposed closer to the front end of the cleaner body 1 than the vertical axis R2 of rotation of each front caster 55. The shape of the front face of the cleaner body 1 is curved. When viewed from the top of the cleaner body 1, the external shape of the front face of the cleaner body 1 is substantially similar to the external shape of that portion of the bumper 47 (mounted on the angularly-movable member 45) projecting from the cleaner body 1, as shown in FIG. 4. With such an external shape of the bumper 47 mounted on the angularly-movable member 45, when moving the cleaner body 1 by pulling the intake hose 10, the bumper 47 is positively caused to first collide with an obstacles 64, such as a table and a desk, on the surface to be cleaned.

Although it is most preferably that the angularly-movable member 45 is angularly movable in a horizontal direction about the vertical axis R1 of angular movement, the axis R1 of angular movement may be inclined so that the angularly-movable member 45 can be angularly moved in an inclined direction.

The recess 56*a* and the hose stand retainer 57 provided at the front lower surface of the cleaner body 1 are disposed centrally of the transverse width of the cleaner body 1. In the condition in which the fixed hook 60 is engaged with the hose stand retainer 57, the outermost periphery of the suction member 59 is disposed generally flush with the outermost periphery of the rear face of the cleaner body 1. A handle holder lid 65 is fixedly secured to the inner bottom of the recess 56*a* by screws or the like. The upper wall of the handle holder lid 65 also serves as a roller guide plate for the roller 53 so as to allow a smooth angular movement of the angularly-movable member 45.

A cord 66 having a power plug is wound around the cord reel 62, and the cord reel 62 has a cord stopper 67. A detachable lid 68 is attached to the container chamber 61 for containing small attachments.

An elastic support 70 is formed integrally with the seal packing 27 mounted on the edge of the opening of the dust collector container 24. The elastic support 70 serves to guide the pressure to a pressure sensor 69 mounted on the lid member 6 closing the opening of the dust collector chamber 5. A small hole 71 is formed in that portion of the inner lid 8 which is brought into contact with the elastic support 70 when the lid member 6 is closed. The small hole 71 is communicated with the pressure sensor 69 via a tube 72.

A seal packing 73 is disposed between the motor case 29 and the lower case cover 38, and is mounted on the periphery of the lower opening 29*b* of the motor case 29.

Figure 6:
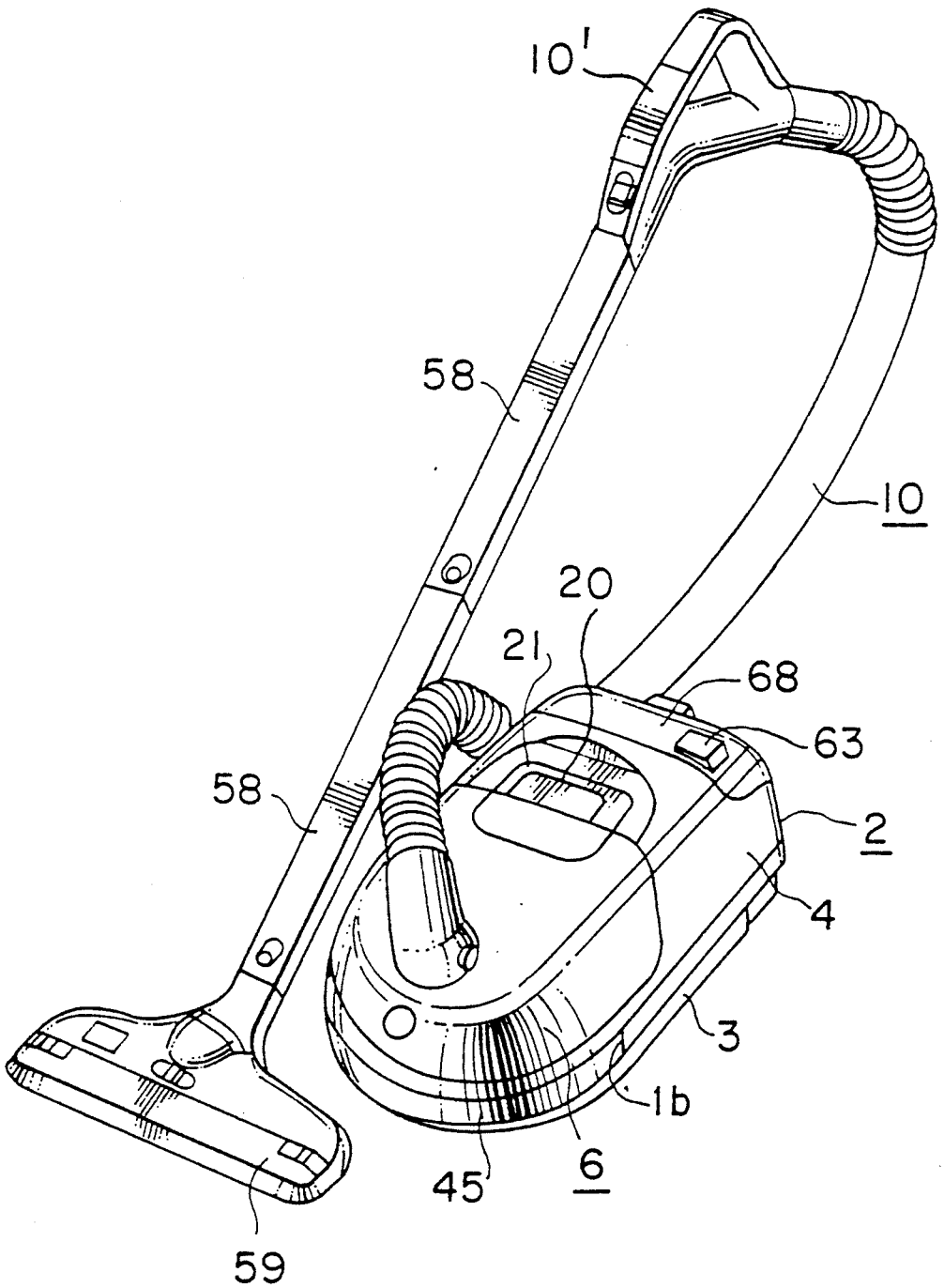

In the above construction, for carrying out the cleaning operation, the intake hose 10, the extension pipes 58 and the suction member 59 are connected to the cleaner body 1, as shown in FIG. 6.

Figure 4A:
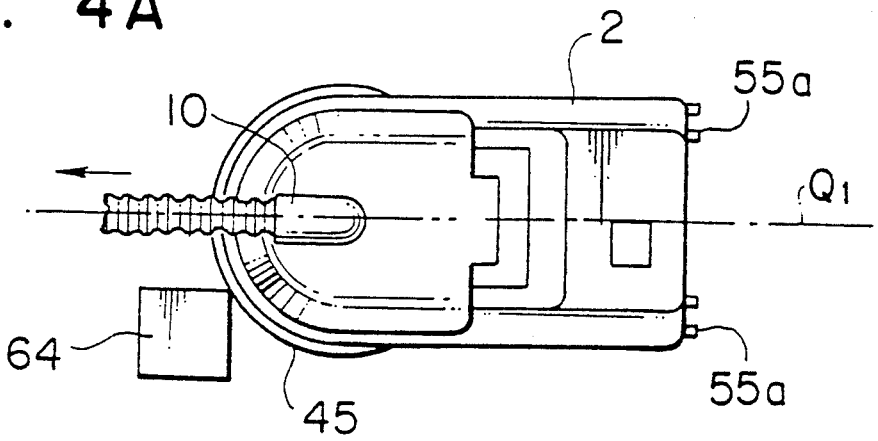
FIGS. 4A, 4B and 4C are schematic views illustrative of an obstacle-escaping operation.

During the cleaning operation, the cleaner body 1 is caused to travel, by the front and rear casters 55 and 55*a*, on the surface of a floor, a carpet, a mat or the like to be cleaned, pulling the intake hose 10. In this case, the bumper 47 of the cleaner body 1 collides with the obstacle 64, such as the furniture placed on the surface to be cleaned and a pillar, as shown in FIG. 4A. In this condition, when the suction hose 10 is further pulled, the bumper 47 is angularly moved together with the angularly-movable member 45, as shown in FIG. 4B, and the cleaner body 1 turns in a direction away from the obstacle 64 without falling, as shown in FIG. 4C, so that finally, the cleaner body 1 is smoothly moved to a position to escape the obstacle 64.

When the bumper 47 is moved away from the obstacle 64, the bumper 47 is angularly moved and returned to its initial position under the influence of the angular movement spring 50.

Figure 4B:
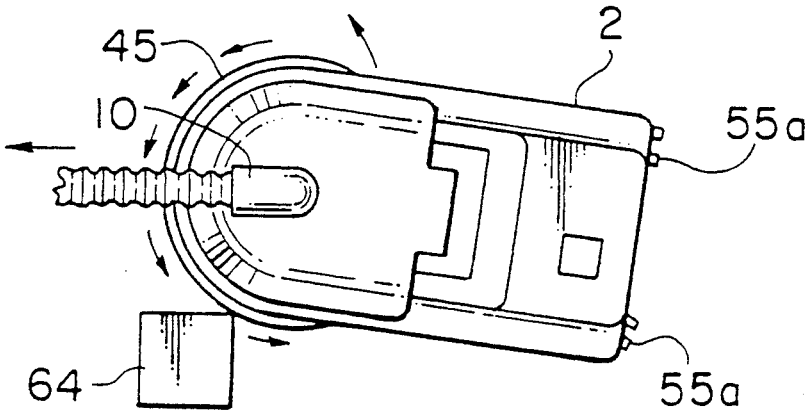
Figure 4C:
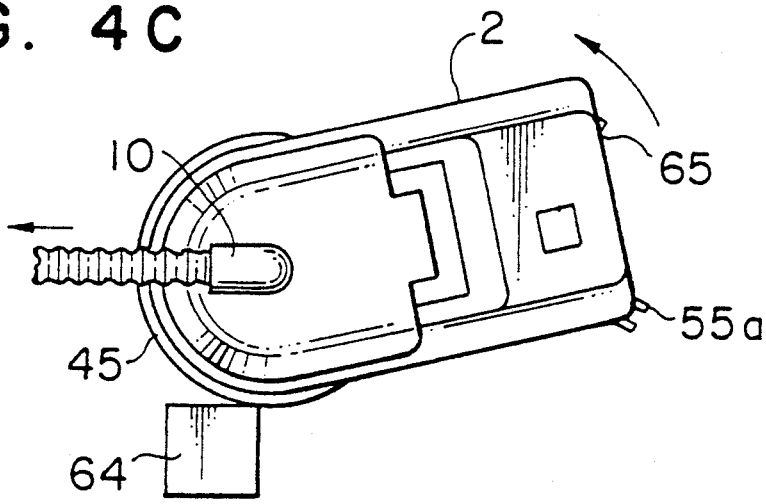

The operations in FIGS. 4A, 4B and 4C can be done even at such a place where the front and rear casters 55 and 55*a* sink into the carpet or the like. When comparing the cleaner of the invention with a conventional cleaner under the same conditions, the operating force for the cleaner of the invention is much improved.

FIGS. 15 to 26 shows other embodiments of the invention. The same portions of FIGS. 15 to 26 as those of FIGS. 1 to 14 are designated by identical reference numerals, respectively.

Figure 15:
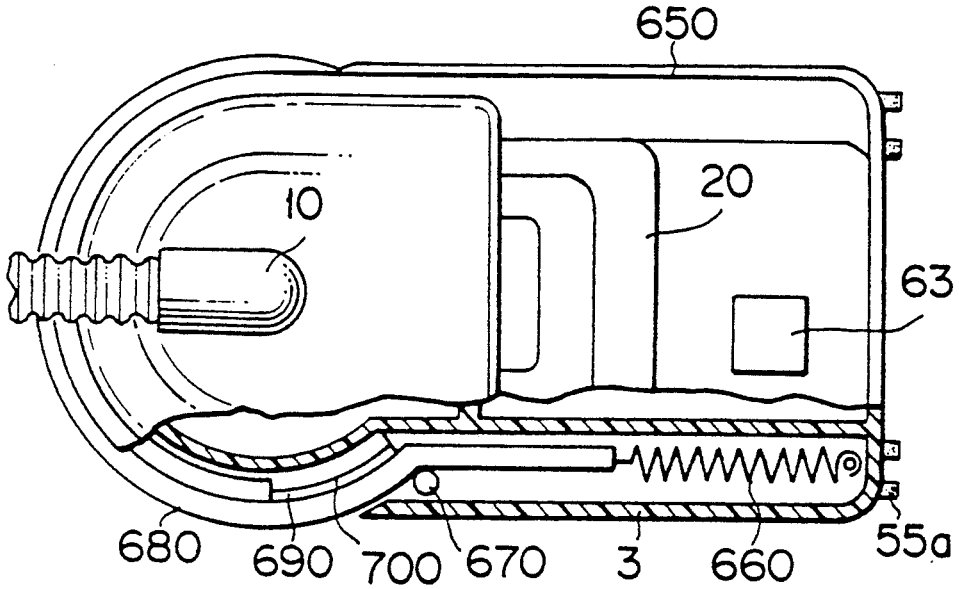
Figure 16:
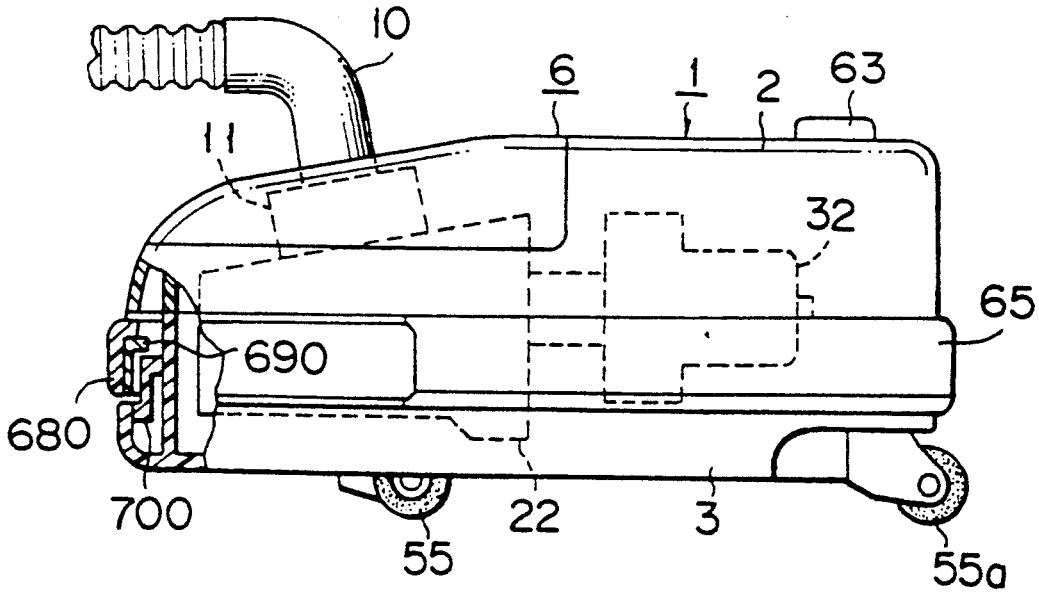

FIGS. 15 and 16 shows a first one of the other embodiments. A belt-like movable bumper 680 is mounted on a support member 690, and is angularly movable along a guide portion 700. Tension springs 660 are connected to both ends of the movable bumper 680, respectively. Roller portions 670 are provided so as to make the movement of the movable bumper 680 smooth. At the front face of a cleaner body 1 and a portion of each of the opposite side surfaces of the cleaner body 1 continuous with the front face, the movable bumper 680 is projected beyond upper and lower cases 2 and 3 constituting a shell of the cleaner body 1. At that portion of the cleaner body 1 where the movable bumper 680 is not projected, a fixed bumper 650 is provided between the upper and lower cases 2 and 3.

Figure 17:
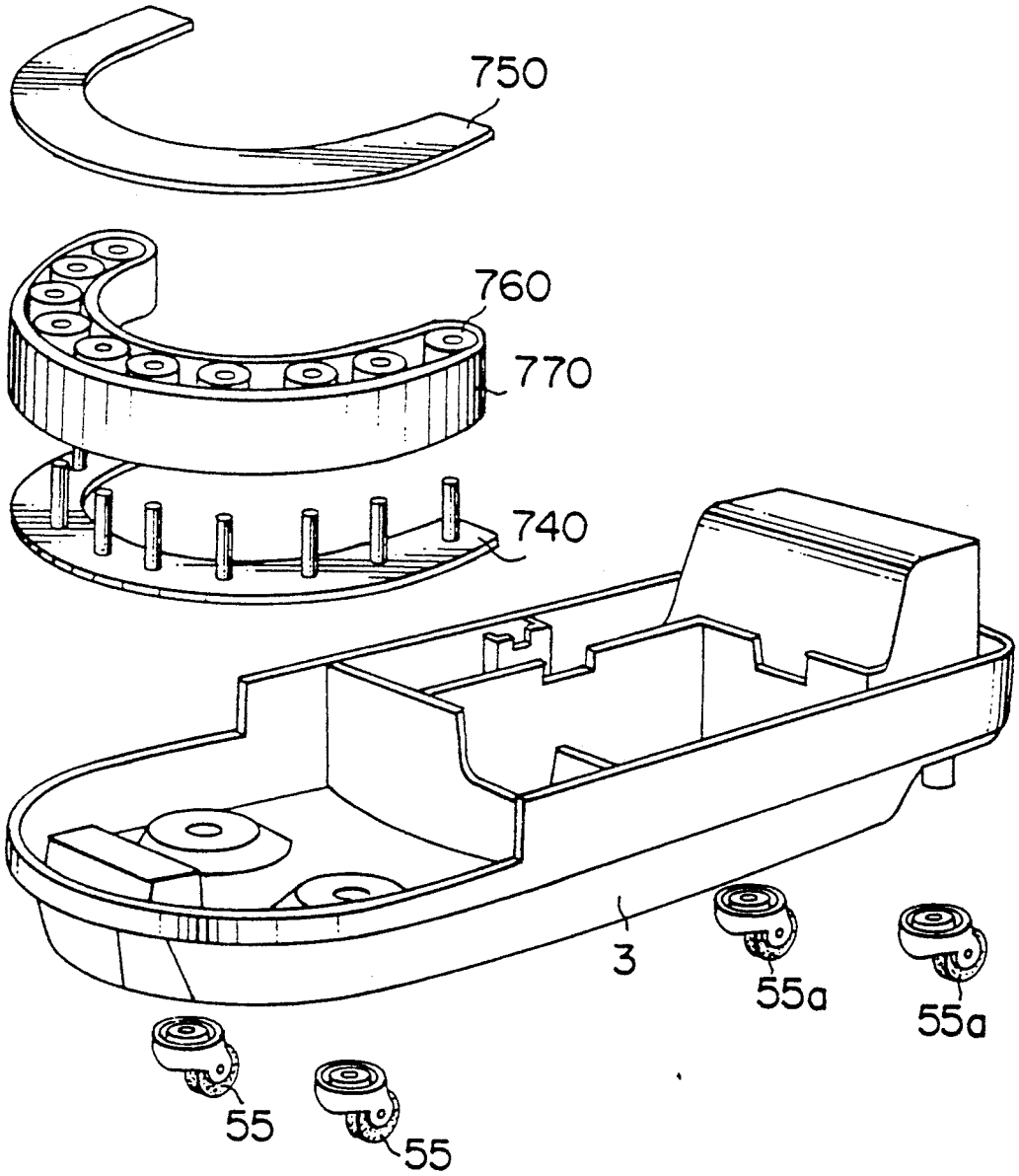

FIG. 17 shows a second one of the other embodiments. A number or group of rollers 760 are held between a holder member 740 and a cover 750, and a loop-shaped bumper 770 is angularly movable around the group of rollers 760, thus providing a caterpillar construction. The bumper 770 is provided between an upper case 2 and a lower case 3.

Figure 18:
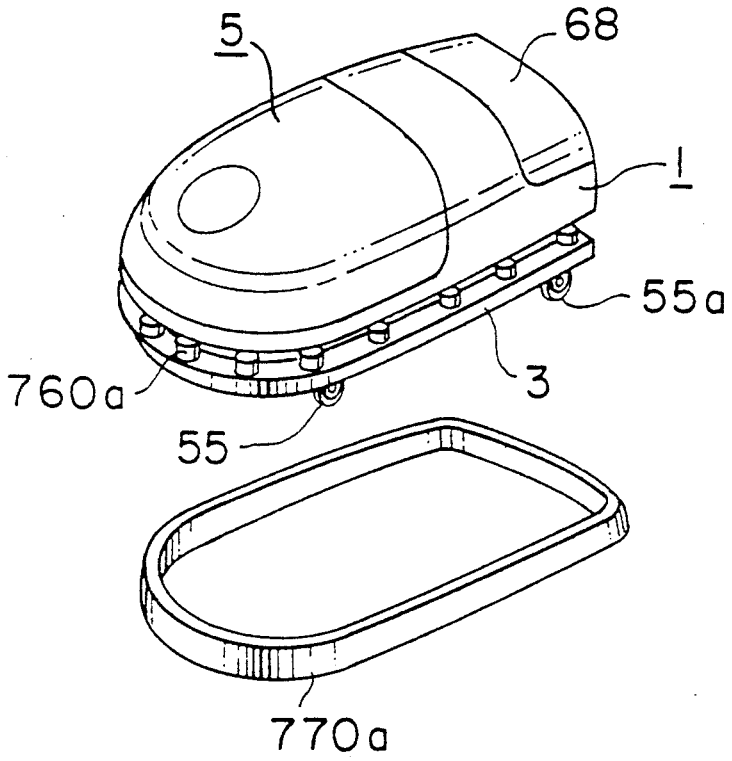
Figure 19:
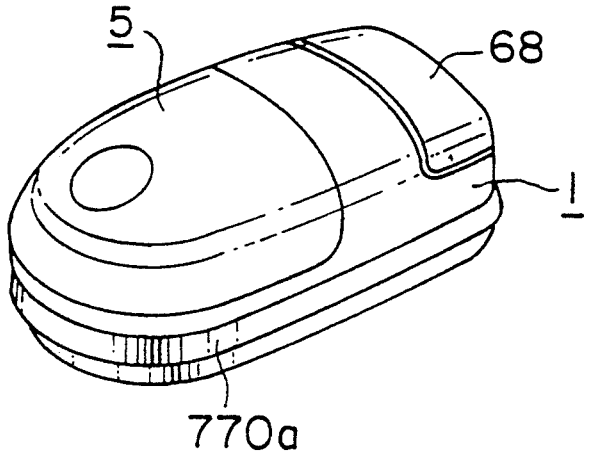
Figure 20:
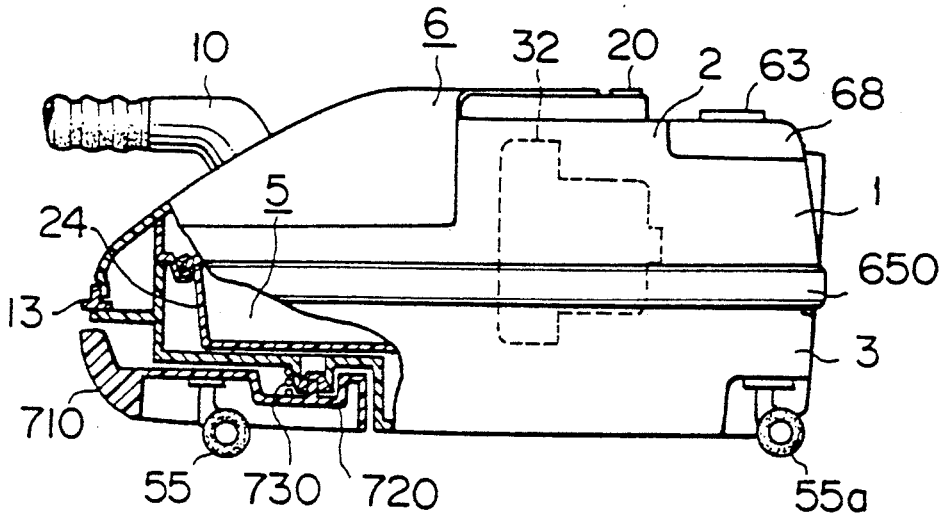

FIGS. 18 and 19 show a third one of the other embodiments. A number of rollers 760*a* are mounted at the entire periphery of a cleaner body 1, and a loop-shaped bumper 770*a* is angularly movable around the group of rollers 760*a*. The bumper 770*a* is provided at a portion where upper and lower cases are connected together, as described above for FIG. 17.

Figure 21:
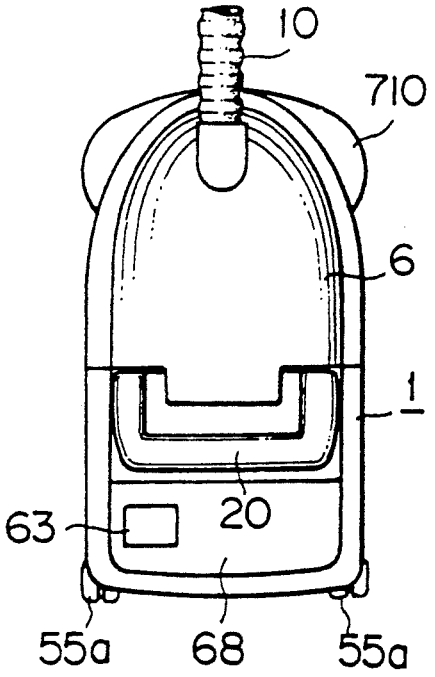
Figure 22:
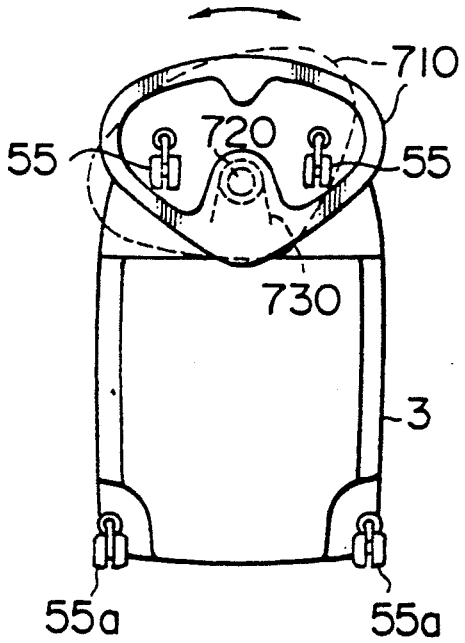
Figure 23:
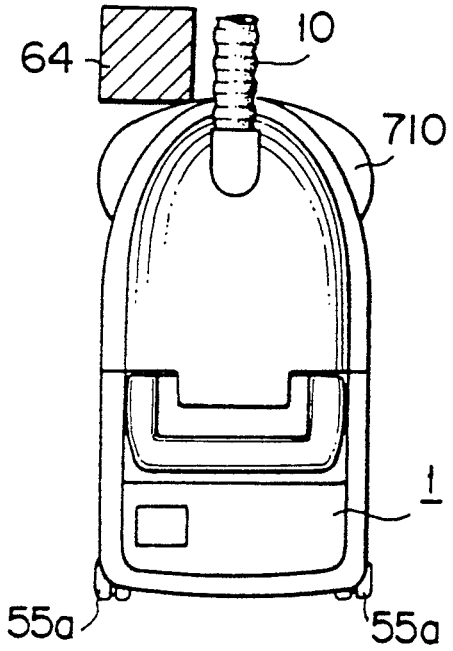
Figure 24:
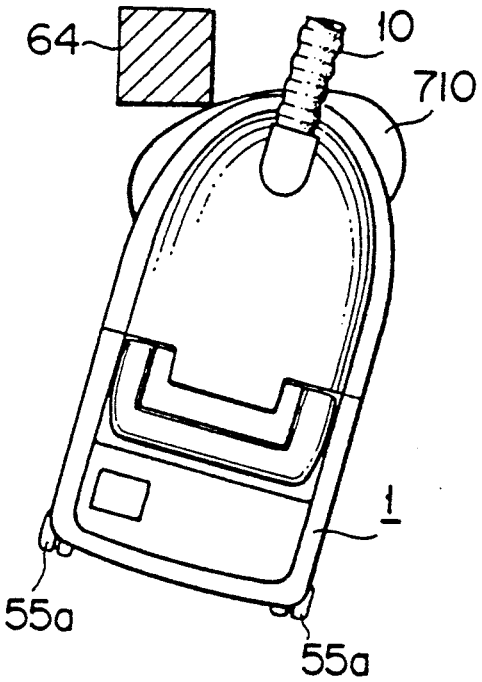

FIGS. 20 to 24 show a fourth one of the other embodiments. A swinging plate 710 is mounted on a front lower surface of a cleaner body 1. The swinging plate 710 is angularly movable right and left about a shaft portion 720. A pair of front casters 55 are mounted on the lower surface of the swinging plate 710. A spring member 730 is mounted on the swinging plate 710. The spring member 730 produces a spring force for angularly returning the swinging plate 710 to its initial position when the swinging member 710 is angularly moved. As shown in FIG. 21, the swinging plate 710 is held in its neutral position when the obstacle does not collide with the swinging plate 710.

Figure 25:
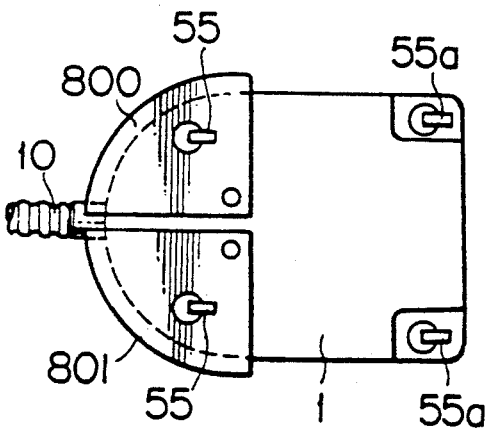

FIG. 25 shows a fifth one of the other embodiments. Two swinging plates 800 and 801 are provided. One front caster 55 is mounted on each of the swinging plates 800 and 801. A return spring is mounted on each of the swinging plates 800 and 801 so as to return the swinging plate to its initial position when the swinging plate is angularly moved.

Figure 26:
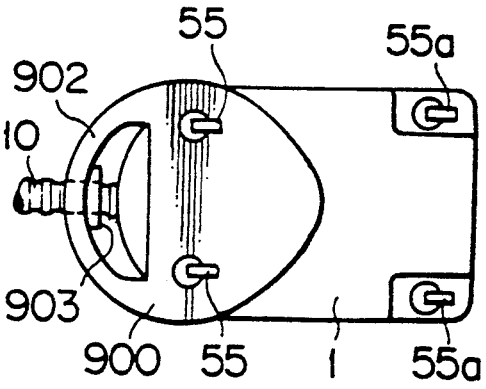

FIG. 26 shows a sixth one of the other embodiments. A swinging plate 900 is mounted on a front lower surface of a cleaner body 1. The swinging plate 900 is angularly movable right and left about a shaft portion 901. Two front casters 55 are mounted on a lower surface of the swinging plate 900. The swinging plate 900 has a handle portion 902. A lock mechanism 903 is provided at the handle portion 902. When the handle portion 902 is grasped, the lock mechanism 903 stops the angular movement of the swinging plate 900.

According to the above embodiments of the invention, the following advantages are achieved:

(1) When the cleaner body 1 is abutted against the obstacle 64 such as a leg of a desk during the cleaning, the obstacle 64 can be avoided easily with a small operating force, and therefore the handling ability is excellent, and also the traveling ability is excellent.

(2) Since the cleaner body 1 always escapes from the obstacle 64, the cleaning operation is not interrupted by the removal of the obstacle, and therefore can be continued. Thus, the cleaning efficiency is excellent.

(3) The cleaner body hardly gets caught by the obstacle 64, and as a result excessive forces will not be exerted on the intake hose 10 and the cleaner body 1, and therefore the reliability of the component parts is high, and this cleaner is economical.

(4) When the cleaner body 1 collides with the obstacle such as the furniture, the bumper and the angularly-movable member change the impact force into components to reduce this force, and also receive component forces due to the spring force of the angular movement spring contained therein. Therefore, the impact can be relieved, and the furniture is less liable to damage, and the cleaner body 1 is not subjected to damage, thus providing the safety.

Referring to a modification of the invention, with respect to a business-purpose cleaner in which a suction member is connected to a cleaner body via an intake hose, and is adapted to be fixed to the cleaner body, it is considered that a support base having casters at its lower surface is swingably mounted on the suction member. Preferably, a return spring is mounted on the support base, so that when the support base is moved away from an obstacle after the support base is angularly moved upon collision with the obstacle, the return spring urges the support base to be angularly returned to its initial position.

Further, in an upright-type cleaner comprising a cleaner body including therein an electrically-operated fan and a dust collector chamber, a suction member to which the cleaner body is tiltably connected, and a traveling means for enabling the traveling of the suction member, it is considered that an angularly-movable member for avoiding an obstacle is mounted on the other periphery of the suction members. In this case, it is preferred that the angularly-movable member is in the form of a belt-like bumper movable around the entire outer periphery of the suction member.

According to the present invention, there is provided the vacuum cleaner comprising the cleaner body to which the intake hose is connectable, the traveling member for enabling the traveling of the cleaner body, and the obstacle-avoiding angularly-movable member angularly movably mounted on the cleaner body, the dust collector chamber being formed in the front portion of the cleaner body, the electrically-operated fan being provided in the rear portion of the cleaner body, the angularly-movable member being so arranged as to be angularly movable around the outer wall of the dust collector chamber, and part of the angularly-movable member being projected from the front face of the cleaner body and the front side surfaces of the cleaner body. With this construction, even if the outer contour of the cleaner body is generally flat, the vacuum cleaner can easily avoid the obstacle, and is excellent in traveling and handling abilities.

What is claimed is:

1. A vacuum cleaner comprising:

a cleaner body to which an intake hose is connectable, said cleaner body having a front lower surface and a rear lower surface;

a swinging plate mounted through a pivot shaft angularly movable on the front lower surface of said cleaner body so as to be angularly movable about said pivot shaft and having a portion projecting outwardly from the outer periphery of said cleaner body to contact an obstacle before said cleaner body contacts the obstacle; and caster means for movably supporting said cleaner body, said caster means comprising first caster means mounted on a lower surface of the swinging plate and second caster means mounted on the rear lower surface of said cleaner body, said angularly-movable member being mounted by a shaft on a front lower surface of said cleaner body so as to be angularly movable about said shaft.

2. A vacuum cleaner comprising:

a cleaner body to which an intake hose is connectable, said body having a front lower surface and a rear lower surface;

an obstacle-avoiding angularly-movable member angularly movable mounted on said cleaner body and having a portion projecting outwardly from the outer periphery of said cleaner body, said angularly-movable member being constituted by a swinging plate, said angularly-movable member being mounted on a shaft on the front lower surface of said cleaner body so as to be angularly movable about said shaft;

casters mounted on a lower surface of said swinging plate; and a resilient member attached to said swinging plate and a portion of the cleaner body for normally holding said swinging plate in a neutral position.

3. A vacuum cleaner according to claim 2, wherein a handle portion is formed at said swinging plate.

4. A vacuum cleaner according to claim 2, wherein a lock mechanism is provided at said handle portion, said lock mechanism being adapted to stop the angular movement of said swinging plate when grasping said handle portion of said swinging plate.

5. A vacuum cleaner according to claim 2, wherein said intake hose is disposed substantially on a centerline of a transverse width of said cleaner body when viewed from a top of the cleaner body, said swinging plate being divided into two portions which are symmetrically disposed to the right and the left with respect to said centerline, and wherein said casters are mounted on each of said divided portions of said swinging plate.

6. A vacuum cleaner comprising:

first caster means for movable supporting said cleaner body;

a suction member connected to said cleaner body via an intake hose;

means for fixing said suction member to said cleaner body; and a support base having second caster means mounted on a lower surface thereof for movable supporting said support base, said support base being swingably mounted on said cleaner body so as to be swung upon contact of the support base with an obstacle before said cleaner body contacts the obstacle.

7. A vacuum cleaner comprising:

a cleaner body;

a suction member connected to said cleaner body via an intake hose;

means for fixing said suction member to said cleaner body;

a support base having casters mounted on a lower surface thereof, said support base being swingably mounted on said cleaner body so as to be angularly moved in one direction upon contacting an obstacle on a surface to be cleaned and angularly movable in an opposite direction to said one direction to return to an initial position when said support base is moved away from said obstacle and;

return means for angularly returning said support base to the initial position.

8. A vacuum cleaner according to claim 2, wherein said resilient member is a spring.

* * * * *

UNITED STATES PATENT AND TRADEMARK OFFICE

CERTIFICATE OF CORRECTION

PATENT NO. : 5,214,822

DATED : June 1, 1993

INVENTOR(S) : SAKURAI ET AL.

It is certified that error appears in the above-identified patent and that said Letters Patent is hereby corrected as shown below:

ON THE TITLE PAGE:

[30] Foreign Application Priority Data

Sep. 29, 1989 [JP] Japan .....1-251930
Oct. 20, 1989 [JP] Japan .....1-271684

Signed and Sealed this

Twenty-ninth Day of March, 1994

Bruce Lehman

BRUCE LEHMAN

*Commissioner of Patents and Trademarks*

*Attest:*

*Attesting Officer*